United States Patent [19]

Izaki et al.

[11] Patent Number: 4,800,134

[45] Date of Patent: Jan. 24, 1989

[54] HIGH CORROSION RESISTANT PLATED COMPOSITE STEEL STRIP

[76] Inventors: Teruaki Izaki; Makoto Yoshida; Masami Osawa; Seijun Higuchi; Akinori Maruta, all c/o Nippon Steel Corporation Yawata Works, 1-1-1, Edamitsu, Yahatahigashi-ku, Kitakyushu-shi, Fukuoka, Japan

[21] Appl. No.: 136,842

[22] Filed: Dec. 22, 1987

[30] Foreign Application Priority Data

| | | | |
|---|---|---|---|
| Apr. 13, 1987 | [JP] | Japan | 62-88693 |
| May 9, 1987 | [JP] | Japan | 62-111684 |
| Jun. 24, 1987 | [JP] | Japan | 62-155597 |
| Jun. 24, 1987 | [JP] | Japan | 62-155598 |
| Jun. 30, 1987 | [JP] | Japan | 62-161304 |

[51] Int. Cl.[4] ..... B32B 15/18

[52] U.S. Cl. ..... 428/626; 428/632; 428/639; 428/640; 428/659

[58] Field of Search ..... 428/626, 632, 639, 640, 428/659

[56] References Cited

U.S. PATENT DOCUMENTS

| | | | |
|---|---|---|---|
| 3,791,801 | 2/1974 | Ariga et al. | 428/659 |
| 4,524,111 | 6/1985 | Oka et al. | 428/659 |

FOREIGN PATENT DOCUMENTS

| | | | |
|---|---|---|---|
| 174019 | 3/1986 | European Pat. Off. | 428/659 |
| 48109 | 9/1981 | Japan | 428/640 |

*Primary Examiner*—L. Dewayne Rutledge
*Assistant Examiner*—Robert L. McDowell

[57] ABSTRACT

A plated composite steel strip having a high corrosion resistance comprises a steel strip substrate, a base electroplating layer comprising a Zn or Zn alloy matrix, substantially water-insoluble chromate particles, and additional fine or colloidal particles of $SiO_2$, $TiO_2$, $Cr_2O_3$, $Al_2O_3$, $ZrO_2$,$SnO_2$ and/or $Sb_2O_5$, and optionally, an additional electroplating layer formed on the base layer and consisting of Zn, Fe, Co, Ni, Mn and/or Cr and/or a surface coating layer containing at least an organic resinous surface layer and formed on the base, or an additional electroplating layer.

12 Claims, 5 Drawing Sheets

HIGH CORROSION RESISTANT PLATED COMPOSITE STEEL STRIP

BACKGROUND OF THE INVENTION

1. Field of the Invention

The present invention relates to a high corrosion resistant plated composite steel strip and a method for producing the same. More particularly, the present invention relates to a high corrosion resistant plated composite steel strip having a composite coating layer comprising a zinc-based electroplating layer containing corrosion resistance-promoting solid particles, and a method for producing the same.

2. Description of the Related Art

It is known that, in the winter in North America and Europe, freezing (icing) of road surfaces is prevented by sprinkling rock salt powder or calcium chloride powder on the road surface. However, the above mentioned icing-preventing material causes corrosion and rusting of the bodies of cars traveling on those roads.

Accordingly, there is a demand for a high corrosion resistant plated steel strip for car bodies which can be used under the above-mentioned circumstances, without allowing the forming of red rust on the car bodies, over a long period.

There are two approaches for meeting the above-mentioned demand.

In countries, for example, the U.S.A. and Canada, where the cost of electricity is relatively low, the corrosion resistance of the steel strip is promoted by forming a thick corrosion resistant coating layer on the steel strip. However, the thick coating layer causes the resultant coated steel strip to exhibit a reduced weldability, paint adhesion and plating propeties.

In other countries, for example, Japan, where electricity is expensive and a high weldability and good paint adhesion and plating properites are required for the steel strip to be used for car bodies, a plated steel strip having a thin corrosion resistant electroplating layer has been developed.

The plated steel strip of the present invention belongs to the above-mentioned category of plated steel strips having a thin corrosion resistant electroplating layer.

In this type of conventional electroplated steel strip having a thin electroplating layer, a zinc alloy, for example a zinc-iron, zinc-nickel or zinc-manganese alloy, is plated on a steel strip substrate, or zinc or a zinc-nickel alloy is electroplated on a steel strip substrate and a chromate treatment and an organic resinous paint are then applied to the electroplating layer. The zinc alloy-electroplated or zinc or zinc alloy-electroplated and painted steel strips have a thin coating layer at a weight of 20–30 g/m$^2$. The conventional electroplated steel strips having the above-mentioned thin coating layer are not considered satisfactory for attaining the object of the domestic and foreign car manufacturers, i.e., that the car bodies should exhibit a resistance to corrosion to an extent such that rust does not form on the outer surfaces of the car bodies over a period of use of at least 5 years, and perforation from the outer and inner surfaces of the car bodies does not occur over a period of use of at least 10 years. In particular, a 10 year resistance to perforation is demanded.

Under the above-mentioned circumstances, recently, investigations have been made into the obtaining of a high corrosion resistant steel strip having a coating layer in which corrosion resistive fine solid particles are co-deposited within a plating metal matrix and are evenly dispersed within the plating metal matrix, i.e., a high corrosion resistant plated composite steel strip.

The co-deposited, dispersed fine solid particles can impart various properties to the plating layer of the plated composite steel strip, and thus this co-deposition type plating method has been developed as a new functional plating method. Namely, this type of plating method has been recently disclosed in Japanese Unexamined Patent Publication Nos. 60-96786, 60-211094, 60-211095 and 60-2111096.

Japanese Unexamined Patent Publication No. 60-96786 discloses a method for producing a plated composite steel strip in which fine solid particles of rust-resistant pigments, for example, $PbCrO_4$, $SrCrO_4$, $ZnCrO_4$, $BaCrO_4$, $Zn_3(PO_4)_2$ are co-deposited with a plating metal matrix, for example, Zn or a Zn-Ni alloy, to be evenly dispersed in the plating metal matrix. This type of plated composite steel strip is considered to have an enhanced resistance to rust and perforation. However, according to the result of study by the inventors of the present invention, the plated composite steel strip of Japanese Unexamined Patent Publication No. 60-96786, in which the fine solid particles dispersed in the plating layer consist of rust-resistant pigments consisting of substantially water-insoluble chromates, for example, $PbCrO_4$, $SrCrO_4$, $ZnCrO_4$ or $BaCrO_4$, cannot realize the above-mentioned corrosion resistance level of no rust for at least 5 years and no perforation for at least 10 years. This will be explained in detail hereinafter.

Generally, the rust resistant pigment fine particles of the substantially water-insoluble chromates dispersed in a zinc-plating liquid exhibit a surface potential of approximately zero, and accordingly, when a steel strip is placed as a cathode in the zinc-plating liquid and is electrolytically treated, zinc ions are selectively deposited on the steel strip surface but it is difficult to deposit the rust resistant pigment fine particles into the zinc-plating layer. Therefore, it is very difficult to obtain a plated composite steel strip having an enhanced corrosion resistance.

Japanese Unexamined Patent Publication No. 60-211095 discloses a plated composite steel strip having a Zn-Ni alloy plating layer in which fine solid particles of metallic chromium, alumina ($Al_2O_3$) or silica ($SiO_2$) are co-deposited with and dispersed in a Zn-Ni alloy matrix. According to the disclosure of this Japanese publication No. 1095, the metallic chromium is obtained from chromium chloride ($CrCl_3$). That is, chromium chloride is dissolved in the plating liquid and releases chromium ions ($Cr^{3+}$). When the steel strip is immersed and electrolytically plated as a cathode in the plating liquid, metallic chromium particles and chromium oxide ($Cr_2O_3.nH_2O$) particles are deposited into the playing layer to form a Zn-Ni alloy plating layer containing metallic chromium (Cr) and chromium oxide ($Cr_2O_3.nH_2O$) particles.

When alumina or silica particles are further co-deposited into the Zn-Ni-Cr-$Cr_2O_3.nH_2O$ plating layer, the resultant plated composite steel strip exhibits an enhanced corrosion resistance compared with the plated composite steel having the Zn-Ni-Cr-$Cr_2O_3.nH_2O$ layer. However, the degree of enhancement of the corrosion resistance is small, and the $Al_2O_3$ or $SiO_2$ particle-containing, plated composite steel strip cannot realize a perforation resistance for at least 10 years.

Under the above-mentioned circumstances, it is desired by industry, especially the car industry, that a high corrosion resistance plated composite steel strip having a rust resistance for at least 5 years and a perforation resistance for at least 10 years be provided, and a method for producing the same.

SUMMARY OF THE INVENTION

An object of the present invention is to provide a high corrosion resistant plated composite steel strip having an enhanced rust resistance for a period of at least 5 years and a perforation resistance for a period of at least 10 years, and a method for producing the same.

The above-mentioned object can be attained by the high corrosion resistant plated composite steel strip of the present invention which comprises (A) a substrate consisting of a steel strip; and (B) a corrosion resistant coating layer formed on at least one surface of the steel strip substrate and comprising a base electroplating layer which comprises (a) a matrix consisting of a member selected from the group consisting of zinc and zinc alloys; (b) a number of dispersoid particles evenly distributed in the matrix and consisting of a mixture of (i) at least one type of substantially water-insoluble chromate fine particles, and (ii) at least one type of additional fine or colloidal particles consisting of a member selected from the group consisting of $SiO_2$, $TiO_2$, $Cr_2O_3$, $Al_2O_3$, $ZrO_2$, $SnO_2$ and $Sb_2O_5$.

The high corrosion resistant plated composite steel strip mentioned above is produced by the method of the present invention which comprises; coating at least one surface of a substrate consisting of a descaled steel strip by at least first electroplating the substrate surface with a first electroplating liquid containing (a) matrix-forming metal ions selected from the group consisting of zinc ions and mixtures of ions of zinc and at least one metal other than zinc to be alloyed with zinc, (b) a number of dispersoid particles evenly dispersed in the liquid and consisting of a mixture of (i) at least one type of substantially water-insoluble chromate fine particles and (ii) at least one type of additional fine or colloidal particles consisting of a member selected from the group consisting of $SiO_2$, $TiO_2$, $Cr_2O_3$, $Al_2O_3$, $ZrO_2$, $SnO_2$, and $Sb_2O_5$, and (c) a co-deposition-promoting agent for promoting the co-deposition of the dispersoid particles together with the matrix-forming metal, to form a base electroplating layer on the substrate surface.

DESCRIPTION OF THE PREFERRED EMBODIMENTS

In the high corrosion resistant plated composite steel strip of the present invention, at least one surface of a steel strip substrate is coated with a corrosion resistant coating layer comprising at least a base electroplating layer.

The base electroplating layer comprises a plating matrix consisting of zinc or a zinc alloy and a number of dispersoid particles evenly dispersed in the matrix. The dispersoid particles consist of a mixture of (i) at least one type of substantially water-insoluble chromate fine particles and (ii) at least one type of additional fine or colloidal particles selected from $SiO_2$, $TiO_2$, $Cr_2O_3$, $Al_2O_3$, $ZrO_2$, $SnO_2$ and $Sb_2O_5$ particles.

Figure 1:
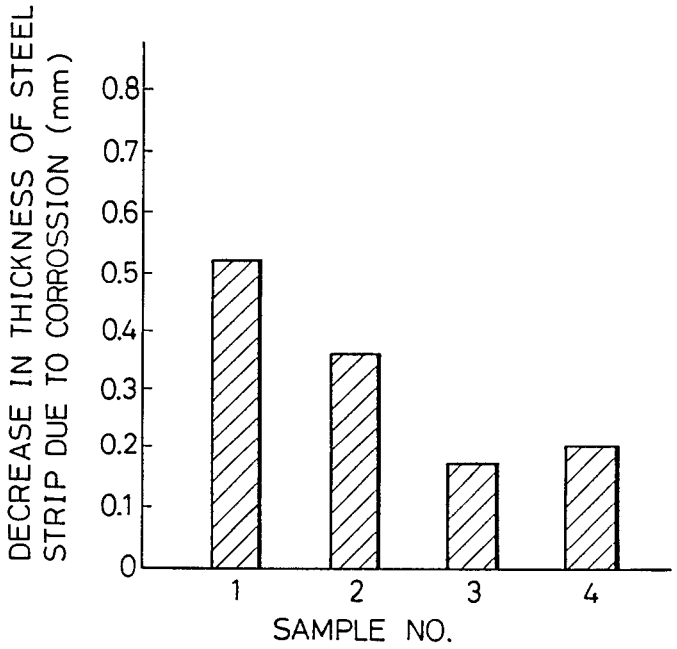
FIG. 1 shows the corrosion resistances of an embodiment of the high corrosion resistant plated composite steel strip of the present invention, and comparative conventional plated composite steel strips and a comparative conventional zinc-galvanized steel strip.

Referring to FIG. 1, which shows decreases in thickness of four different plated composite steel strips by a corrosion test, sample No. 1 is a plated composite steel strip which was produced in accordance with the method disclosed in Japanese Unexamined Patent Publication (Kokoku) No. 60-96,786 and had 23 g/m$^2$ of an electroplating layer consisting of a zinc matrix and 0.3% by weight of $BaCrO_4$ particles dispersed in the matrix.

Sample No. 2 is a plated composite steel strip which was produced in accordance with the method disclosed in Japanese Unexamined Patent Publication (Kokai) No. 60-211,095 and had 20 g/m$^2$ of an electroplating layer consisting of a matrix consisting of a zinc-nickel alloy containing 1% by weight of Ni and a dispersoid consisting of 1% by weight of metallic chromium (Cr) and chromium oxide particles and 1% by weight of $Al_2O_3$ particles dispersed in the matrix.

Sample No. 3 is a plated composite steel strip of the present invention having 21 g/m$^2$ of an electroplating layer consisting of a matrix consisting of a zinc-iron alloy containing 10% by weight of Fe and a dispersoid consisting of 3% by weight of $SrCrO_4$, particles and 0.3% by weight of $Al_2O_3$ particles (additional particles).

Sample No. 4 is a zinc-galvanized steel strip which has 90 g/m$^2$ of a thick zinc-galvanizing layer and is believed to exhibit a high perforation resistance over a long period of 10 years or more.

The corrosion test was carried out in such a manner that a corrosion treatment cycle comprising the successive steps of a salt water-spraying procedure at a temperature of 35° C. for 6 hours, a drying procedure at a temperature of 70° C. at a relative humidity of 60%RH for 4 hours, a wetting procedure at a temperature of 49° C. at a relative humidity of more than 95%RH for 4 hours, and a freezing procedure at a temperature of −20° C. for 4 hours, was repeatedly applied 50 times to each sample.

In FIG. 1, the perforation resistances of Sample No. 1, the plated zinc layer of which contained $BaCrO_4$ particles, and Sample No. 2, the plated zinc-nickel alloy layer of which contained metallic chromium and chromium oxide particles and $Al_2O_3$ particles, are poorer than that of Sample No. 4 having a thick (90 g/m$^2$) galvanized zinc layer. Also, FIG. 1 shows that the perforation resistance of Sample No. 1, the plated zinc layer of which contains only a substantially water insoluble chromate ($BrCrO_4$) particles in a small amount of 0.3% by weight, is unsatisfactory. That is, by the method of Japanese Unexamined Patent Publication (Kokoku) No. 60-96786, it is difficult to deposit a large amount of the rust-resistant pigment consisting of substantially water-insoluble chromate particles from the electroplating liquid into the zinc plating layer, because the chromate particles in the plating liquid have a surface potential of approximately zero.

Further, FIG. 1 shows that Sample No. 3, i.e., the plated composite steel strip of the present invention, exhibited a higher perforation resistance than that of Sample No. 4.

Namely, in the plated composite steel strip of the present invention, the additional fine particles, for example, $SiO_2$ or $Al_2O_3$ particles, promote the perforation resistance-enhancing effect of the substantially water-insoluble chromate particles in the base electroplating layer.

In the plated composite steel strip of the present invention, preferably the base electroplating layer is formed on the steel strip substrate surface in a total amount of from 5 to 50 $g/m^2$, more preferably from 10 to 40 $g/m^2$.

In the base electroplating layer of the present invention, the matrix thereof consists of zinc or a zinc alloy. The zinc alloy consists of zinc and at least one additional metal member to be alloyed with zinc. The additional metal member is preferably selected from the group consisting of Fe, Co, Mn, Cr, Sn, Sb, Pb, Ni, and Mo. The content of the additional metal member in the zinc alloy is not limited to a specific level.

In the base electroplating layer of the present invention, the total content of the dispersoid particles is preferably 30% or less based on the weight of the base electroplating layer. Also, the substantially water-insoluble chromate fine particles are preferably in a content of from 0.1% to 30%, more preferably 0.1% to 20%, based on the weight of the base electroplating layer.

The substantially water-insoluble chromate unsable for the present invention is preferably selected from the group consisting of $PbCrO_4$, $BaCrO_4$, $SrCrO_4$, $ZnCrO_4$ and $CaCrO_4$. The chromate particles preferably have a size of 10 μm or less, more preferably 0.1 to 6 μm.

In the base electroplating layer of the present invention, the additional fine or colloidal particles are preferably in a content of from 0.1% to 30%, more preferably from 0.1% to 20%, based on the total weight of the base electroplating layer, and have a size of 10 μm or less, more preferably 1 to 6 μm.

In the method of the present invention, at least one surface of a substrate consisting of a descaled steel strip is coated by at least first electroplating the substrate surface in a first electroplating liquid.

The surface of the steel strip to be first electroplated is cleaned by an ordinary surface-cleaning treatment, before the first electroplating step.

The first electroplating liquid contains (a) matrix-forming metal ions selected from zinc ions or a mixture of zinc ions and at least one other metal ion than zinc ions to be alloyed with zinc, (b) a number of dispersoid particles evenly dispersed in the first electroplating liquid, and (c) a co-deposition-promoting agent for promoting the co-deposition of the dispersoid particles together with the matrix-forming metal, to provide a base electroplating layer on the substrate surface.

The dispersoid particles are composed of a mixture of (i) at least one type of substantially water-insoluble chromate fine particles and (ii) at least one type of additional fine or colloidal particles consisting of a member selected from the group consisting of $SiO_2$, $TiO_2$, $Cr_2O_3$, $Al_2O_3$, $ZrO_2$, $SnO_2$ and $Sb_2O_5$.

The co-deposition-promoting agent is used to promote the co-deposition of the dispersoid particles, especially the substantially water-insoluble chromate pigment fine particles, together with the matrix-forming metal, from the first electroplating liquid into the base electroplating layer. The co-deposition-promoting agent preferably comprises at least one member selected from the group consisting of $Ni^{2+}$ ions, $Fe^{2+}$ ions, $Co^{2+}$ ions, $Cr^{3+}$ ions, $TiO_2$ colloid, $Al_2O_3$ colloid, $SiO_2$ colloid, $ZrO_2$ colloid, $SnO_2$ colloid, and $Sb_2O_5$ colloid.

The role of the co-deposition-promoting agent will be explained below.

The substantially water-insoluble chromate particles and usual oxide solid particles dispersed in an aqueous solution have an electric potential of approximately zero. Accordingly, in the electroplating procedure wherein an electrophoresis of ions or charged particles is utilized, it is expected that the substantially non-charged particles will not be deposited in a large enough amount into the plated metal layer.

In experiments by the inventors of the present invention, it was confirmed that, in an electroplating procedure, the substantially non-charged particles such as water-insoluble pigment particles were deposited in a very small amount from the electroplating liquid.

Accordingly, it is necessary to charge the substantially water-insoluble pigment particles to promote the electro-deposition thereof. This can be realized by adding the co-deposition-promoting agent comprising at least one member selected from $Ni^{2+}$, $Co^{2+}$, $Fe^{2+}$, $Cr^{3+}$ ions and $SiO_2$, $TiO_2$, $Al_2O_3$, $ZrO_2$, $SnO_2$ and $Sb_2O_5$ colloids to the first electroplating liquid in accordance with the method of the present invention.

When a co-deposition-promoting agent comprising $Ni^{2+}$ ions is used, a portion of the $Ni^{2+}$ ions is absorbed on the surfaces of the fine particles, for a certain reason, which is not yet clear, in the electroplating liquid to cause the fine particles to be charged with positive electricity and to exhibit a positive potential. Therefore, in a cathodic electrolytic system, the positively charged fine particles are readily drawn to and deposited on a surface of a cathode consisting of a steel strip. The $Co^{2+}$, $Fe^{2+}$ and $Cr^{3+}$ ions in the electroplating layer exhibit the same co-deposition-promoting effect as that of the $Ni^{2+}$ ions. The metal ions $Ni^{2+}$, $Co^{2+}$, $Fe^{2+}$ and $Cr^{3+}$, are also deposited to form a zinc alloy matrix which is effective for enhancing the corrosion resistance of the first electroplating layer.

The $SiO_2$, $TiO_2$, $Al_2O_3$, $ZrO_2$, $SnO_2$ and $Sb_2O_5$ colloids added to the electroplating liquid serve as a co-deposition-promoting agent in the same manner as that of the $Ni^{2+}$ ions, etc.

When added to the electroplating liquid, the colloid particles exhibit a positive or negative potential and are absorbed on the surfaces of the fine particles of the substantially water-insoluble chromates or oxides. For example, at a pH of 1 to 2.5, $Al_2O_3$, $ZrO_2$, $SnO_2$, and $TiO_2$ colloid particles exhibit a positive potential, and $SiO_2$ and $Sb_2O_5$ colloid particles exhibit a negative potential. Accordingly, the nature and intensity of the potential of the fine particles in the electroplating liquid can be adjusted to a desired level by controlling the type and amount of the colloid particles to be added to the electroplating liquid, in consideration of the type of the electroplating method.

When a steel strip is first electroplated with an electroplating liquid containing $Zn^{2+}$ ions, $Ni^{2+}$ ions, substantially water-insoluble chromate fine particles, and $Al_2O_3$ or $SiO_2$ colloidal particles, when the steel strip serves as a cathode the $Ni^{2+}$ ions and the $Al_2O_3$ or $SiO_2$ colloidal particles serve as a co-deposition-promoting agent for the chromate particles and are co-deposited together with the zinc and the chromate fine particles to form a base electroplating layer having an excellent corrosion resistance.

It was found by the inventors of the present invention that, when a plated composite steel strip is subjected to a chemical conversion treatment as a treatment prior to a point coating step, the electroplating metal layer containing the substantially water-insoluble chromate fine particles tends to hinder the growth of chemical conversion membrane crystals. That is, the chemical conversion membrane are only locally formed and the crystals in the membrane are coarse, and therefore, the chemical conversion membrane exhibits a poor adhesion to the paint coating.

Accordingly, where a paint coating is required, for example, on a steel strip to be used for forming outer surfaces of the car bodies, preferably the base electroplating layer is coated with a thin additional electroplating layer, preferably in a weight of 1 to 5 $g/m^2$. The additional electroplating layer preferably comprises at least one type of metal selected from the group consisting of Zn, Fe, Co, Ni, Mn, and Cr.

The base electroplating layer in the plated composite steel strip of the present invention may be coated with a surface coating layer having a coating structure selected from the group consisting of simple coating layers comprising an organic resinous material, and optionally, chromium ions evenly mixed in the paint, and composite coating layers each consisting of an under layer formed by applying a chromate treatment to the base electroplating layer surface and an upper layer formed on the under layer and comprising an organic resinous material. The surface coating layer effectively enhances the first adhesion of the paint to the plated composite steel strip.

The above-mentioned surface coating layer may be further formed on the additional electroplating layer formed on the base electroplating layer.

In the method disclosed in Japanese Unexamined Patent Publication (Kokai) No. 60-96,786, the first electroplating operation is carried out with a first electroplating liquid having a pH of 3.5 or more. Where the steel strip serves as a cathode and the electroplating liquid has a pH of 3.5 or more, the pH at the interface between the cathode and the electroplating liquid is easily increased to a level of pH at which a membrane of $Zn(OH_2)$ is formed, the $Zn(OH)_2$ membrane hinders the deposition of metal ions and the rustresistant pigment particles having a larger size than that of the metal ions onto the cathode surface through the $Zn(OH)_2$ membrane. That is, the formation of the electrocoating layer containing the corrosion-resistant dispersoid particles is obstructed by the $Zn(OH)_2$ membrane formed on the cathode surface. Therefore, the resultant plating layer has an unstable composition, contains a very small amount of the corrosion resistant dispersoid particles, and thus exhibits an unsatisfactory corrosion resistance.

Figure 2:
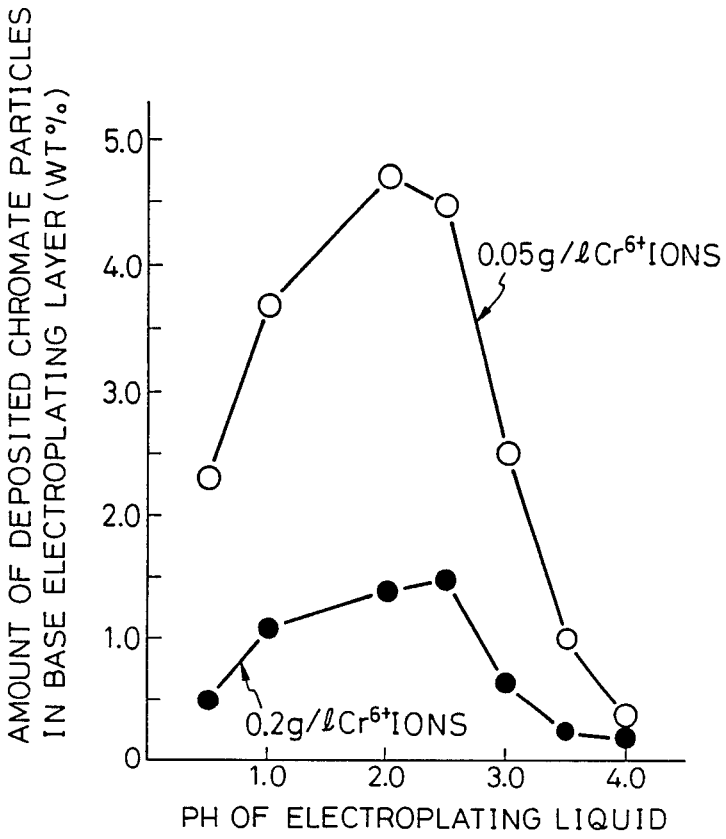
FIG. 2 shows the relationship between the pH of the plating liquids and the amounts of substantially water-insoluble chromate particles deposited from the plating liquids.

Referring to FIG. 2, which shows a relationship between the pH of the electroplating liquid and the amount of substantially water-insoluble chromate fine particles deposited from the electroplating liquid, it is clear that, at a pH of 3.5 or more, the amount of the deposited chromate fine particles becomes very small.

Also, it should be noted that a portion of the chromate particles is dissolved in the electroplating liquid to generate $Cr^{6+}$ ions. If the electroplating operation is carried out in an electroplating liquid containing a large amount of $Cr^{6+}$ ions, the resultant electroplating layer is formed by a black colored powder and exhibits a very poor adhesion to the steel strip substrate. Where the content of $Cr^{6+}$ ions in the electroplating liquid is in the range of from 0.1 to 0.3 g/l, the black colored deposit is not formed in the resultant electroplating layer. However, the electroplating layer contains a very small amount of the substantially water-insoluble chromate fine particles deposited therein.

FIG. 2 suggests that, in the range of a $Cr^{6+}$ ion content of from 0.1 to 0.3 g/l in the electroplating liquid, an increase in the content of the $Cr^{6+}$ ions results in remarkable decrease in the amount of the substantially water-insoluble chromate fine particles deposited.

Figure 3:
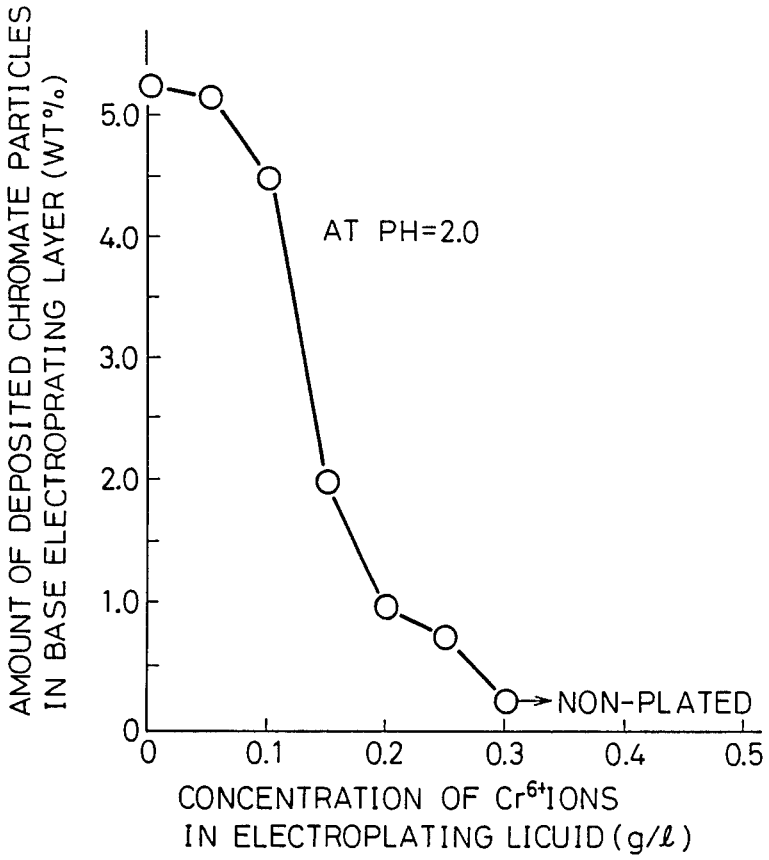
FIG. 3 shows a relationship between a concentraton of $Cr^{6+}$ ions in a plating liquid and an amount of substantially water-insoluble chromate particles deposited from the plating liquid.

Also, referring to FIG. 3 showing a relationship between the content of $Cr^{6+}$ ions in an electroplating liquid and the amount of substantially water-insoluble chromate fine particles deposited from the electroplating liquid, it is clear that the increase in the content of $Cr^{6+}$ result in a remarkable decrease in the amount of the deposited chromate fine particles, and at a $Cr^{6+}$ ion content of 0.3 g/l or more, practical electroplating becomes impossible.

In the method of Japanese Unexamined Patent Publication (Kokai) N0. 60-96,786, an attempt is made to resolve the $Cr^{6+}$ ion problem in the following manner.

That is, where an electroplating liquid contains $BaCrO_4$ fine particles as substantially water-insoluble chromate fine particles, a portion of the $BaCrO_4$ is dissolved in the electroplating liquid and is dissociated, as follows.

$$BaCrO_4 \rightleftharpoons Ba^{2+} + CrO_4^{2-}(Cr^{6+})$$

The reaction in the $\rightarrow$ direction causes the $BaCrO_4$ to be dissolved in the electroplating liquid. To restrict the dissolution reaction, the ionic dissociation of the $BrCrO_4$ should be prevented by, for example, adding $Ba^{2+}$ ions. The addition of $Cr^{6+}$ ions should be avoided, because the increase in the $Cr^{6+}$ ion content in the electroplating liquid results in decrease in the plating utility of the electroplating liquid.

To add $Ba^{2+}$ ions, $BaCl_2$, which has a relatively large solubility in water, is preferably added to the electroplating liquid. In the method of Japanese Unexamined Patent Publication No. 60-96,786, the elctroplating liquid contains chlorides including $BaCl_2$. However, when a non-soluble electrode is used as an anode in a chloride-containing electroplating liquid, chlorine gas is generated from the electroplating liquid. Therefore, a soluble electrode must be used as an anode in the chloride-containing electroplating liquid.

However, in most of the recent electroplating apparatuses, the electrode is a fixed type, and thus is a non-soluble electrode, because generally, in most recent electroplating methods, a horizontal, high flow speed type electroplating cell is used, the distance between the steel strip and electrode is made short to increase the current density to be applied to the electroplating process, and the plated steel strip is produced at a very high efficiency which corresponds to several times that obtained in a conventional electroplating process.

The method of the present invention is very useful for electroplating a steel strip substrate in a horizontal, high flow speed type electroplating apparatuses at a high current density and at a high efficiency. In this type of electroplating process, when a non-soluble electrode is used, the electroplating liquid is preferably a sulfate type plating bath.

In the sulfate type plating bath, the generation of $Cr^{6+}$ ions cannot be prevented by adding $Ba^{2+}$ ions to the bath, because the added $Ba^{2+}$ ions are converted to $BaSO_4$ which is insoluble in water and deposits from the bath.

Accordingly, where the sulfate type plating liquid is used as a first electroplating bath for the method of the present invention, it is preferable to convert the dissolved $Cr^{6+}$ ions to $Cr^{3+}$ ions by adding grains or a plate of a metal, for example, metallic zinc or iron, or a reducing agent, for example, sodium sulfite, in a necessary amount of reducing the dissolved $Cr^{6+}$ ions to $Cr^{3+}$ in the first electroplating liquid. In this manner, an oxidation-reduction reaction is utilized.

Figure 4:
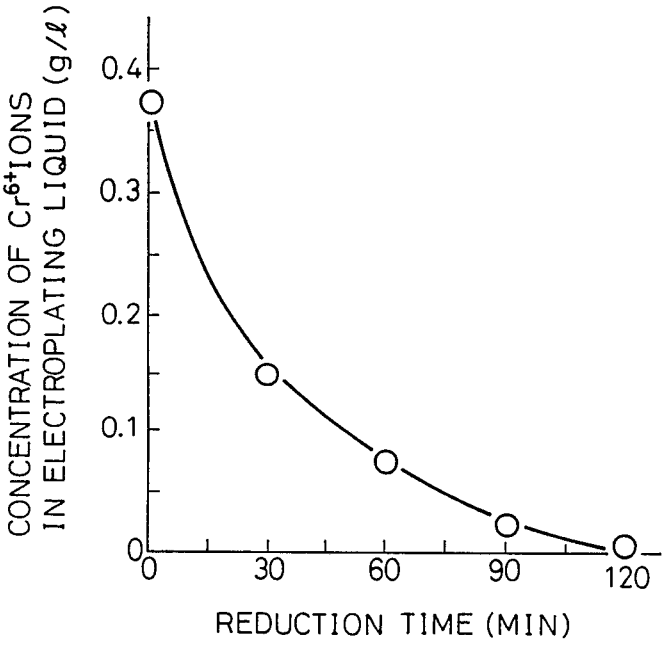
FIG. 4 shows a relationship between an oxidation-reduction reaction time of metallic zinc grains with $Cr^{6+}$ ions in a plating liquid and a concentration of $Cr^{6+}$ ions in the plating liquid and, FIGS. 5A, 5B, 5C, and 5D, respectively, are explanatory cross-sectional views of an embodiment of the plated composite steel strip of the present invention.

FIG. 4 shows a relationship between the reaction time (minute) of metallic zinc grains added in an amount of 20 kg/m$^3$ in an electroplating liquid and the concentration (g/l) of $Cr^{6+}$ ions dissolved in the electroplating liquid. In view of FIG. 4, it is clear that, after the metallic zinc grains are added to the electroplating liquid, the $Cr^{6+}$ ions are reduced to $Cr^{3+}$ ions by the reduction reaction of the zinc grains, and thus the concentration of the $Cr^{6+}$ ions decreases with the lapse of the reaction time.

That is, it was found by the inventors of the present invention for the first time that a high corrosion resistant plated composite steel strip, in which a stable dispersion of the corrosion-resistant solid particles in a satisfactory amount in a base electroplating layer is ensured, can be easily produced by the method of the present invention in which, preferably, the pH of the first electroplating liquid in controlled to a level of 3.5 or less, more preferably from 1 to 2.5, and the concentration of the dissolved $Cr^{6+}$ ions is restricted to a level of 0.1 g/l or less, more preferably 0.05 g/l or less, by adding metal grains or plate or a reducing agent to the first electroplating liquid, at a wide range of current density from a low level to a high level.

The resultant high corrosion resistant plated composite steel strip of the present invention exhibits an excellent metal plating and adhesion, weldability, and painting properties.

Figure 5A:
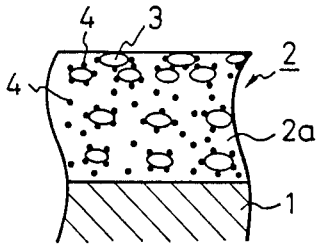

Referring to FIG. 5A, a plated composite steel plate is composed of a steel strip substrate 1 and a base electroplating layer 2, which consists of a metal matrix 2a consisting of zinc or a zinc alloy, for example, an alloy of zinc with at least one member selected from Fe, Co, Mn, Cr, Sn, Sb, Pb, Ni and Mo, and a number of dispersoid particles comprising fine particles 3 consisting of at least one substantially water-insoluble chromate, for example, $PbCrO_4$, $BaCrO_4$, $SrCrO_4$, $ZnCrO_4$, and $CaCrO_4$, and additional fine or colloidal particles 4 consisting of a member selected from $SiO_2$, $TiO_2$, $Cr_2O_3$, $Al_2O_3$, $ZrO_2$, $SnO_2$ and $Sb_2O_5$.

When a plated composite steel strip of the present invention is placed in a corrosive environment, the chromate fine particles in the base electroplating layer are decomposed, due to the corrosion of the base electroplating layer, and release $Cr^{6+}$ ions therefrom. The $Cr^{6+}$ ions react with the metal or metals in the matrix of the base electroplating layer to form certain types of chromium compounds of chromates or chromium hydroxide, which exhibit a high corrosion resistance, so that the plated composite steel strip exhibits a high corrosion resistance. This corrosion resistance-promoting effect of the chromate particles is maintained until the chromate particles evenly distributed in the base electroplating layer are completely consumed over a long period of time.

The content of the substantially water-insoluble chromate fine particles in the base electroplating layer is preferably in the range of from 0.1% to 30%, more preferably from 0.5% to 20%, based on the total weight of the base electroplating layer. When the content is less than 0.1%, the corrosion resistance of the resultant plated composite steel strip may be unsatisfactory. When the content is more than 30%, the bonding property of the resultant base electroplating layer to the steel strip substrate may be unsatisfactory.

The additional fine or colloidal particles 4 per se exhibit a low corrosion resistance-promoting effect compared with that of the chromate fine particles 3. However, the additional particles are deposited in regions in which the chromate particles are not deposited in the base electroplating layer and are effective for preventing corrosion of portions of the base electroplating layers around the additional particles, that is, the additional particles provide a barrier to the corrosion of the base electroplating layer.

When the additional particles are in the form of colloidal particles in the first electroplating liquid, the colloidal particles are absorbed on the surfaces of the chromate fine particles, to cause the chromate fine particles to be charged and to be easily deposited.

The additional fine or colloidal particles are preferably contained in an amount of 0.1% to 30%, more preferably, 0.1% to 20%, based on the total weight of the base electroplating layer. However, the total content of the chromate fine particles and the additional fine or colloidal particles in the base electroplating layer is preferably at a level not exceeding 30%, based on the total weight of the base electroplating layer.

Figure 5B:
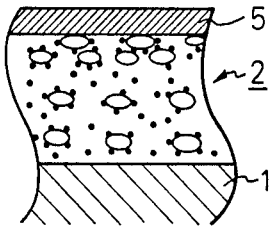
Figure 5C:
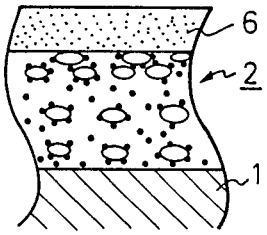

Referring to FIG. 5B, a base electroplating layer 2 formed on a steel strip substrate 1 is coated by a thin additional electroplating layer 5, which comprises at least one member selected from Zn, Fe, Co, Ni, Mn and Cr. Preferably, the additional electroplating layer 5 is in an amount of 1 to 5 g/m$^2$. In FIG. 5C, a base electroplating layer 2 is coated with a coating layer 6. The coating layer 6 may be a single coating layer structure made of an organic resinous material, which optionally contains chromium ions evenly mixed in the resinous material, or a double coating layer structure consisting of an under layer formed by applying a chromate treatment to the base electroplating layer surface and an upper layer formed on the under layer and comprising an organic resinous material as mentioned above.

Figure 5D:
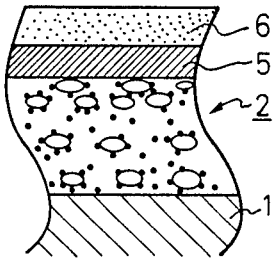

As shown in FIG. 5D, the same coating layer 6 as mentioned above is formed on the additional electroplating layer 5 formed on the base electroplating layer 2.

The coating layer 6 is preferably formed when the base or additional electroplating layer contains chromium. When a chromium-containing compound, for example, the substantially water-insoluble chromate, or metallic chromium is contained in an electroplating layer, and a chemical conversion treatment is applied as a pre-paint coating step to the surface of the electroplating layer, it is known that the resultant chemical conversion membrane contains coarse crystals. The coarse crystals cause the chemical conversion membrane to exhibit a poor paint coating property. Therefore, preferably a surface layer to be chemical conversion-treated is free from chromium compound or metallic chromium.

The organic resinous material usable for the surface coating layer may be selected from epoxy resins, epoxy-phenol resins, and water-soluble polyacrylic resin emulsion type resins.

The organic resinous material may be coated by any conventional coating method, for example a roll-coating method, electrostatic spraying method, and curtain flow method. From the aspect of ensuring the weldability and processability of the resultant plated composite steel strip, the thickness of the organic resinous material layer is preferably 2 μm or less.

In the surface coating layer, the organic resinous material layer is also effective for preventing the undesirable dissolution of chromium from the chromate-treated under layer, which is very effective for enhancing the corrosion resistance of the plated composite steel strip. The dissolution of chromium sometimes occurs when the plated composite steel strip having the chromate treatment layer is subjected to a degreasing procedure or chemical conversion procedure, and can be prevented by coating the chromium compound-containing layer with the resinous material layer, which optionally contains chromium ions.

The present invention will be further explained by way of specific examples which, however, are representative and do not restrict the scope of the present invention in any way.

EXAMPLES 1 TO 25
COMPARATIVE EXAMPLES 1 TO 7

In each of the examples and comparative examples, a cold-rolled steel strip having a thickness of 0.8 mm, a length of 200 mm, and a width of 100 mm was degreased with an alkali aqueous solution, pickled with a 10% sulfuric acid aqueous solution, washed with water, and then dried.

The descaled steel strip was subjected to a first electroplating procedure wherein the steel strip served as a cathode, a first electroplating liquid containing necessary metal ions, substantially water-insoluble chromate fine particles, and additional fine or colloidal particles, as shown in Table 1, was stirred and circulated through an electroplating vessel and a circulating pump, while controlling the amounts of the above-mentioned components to a predetermined level and the concentration of the dissolved $Cr^{6+}$ ions to a level of 0.05 g/l or less, and while maintaining the pH of the first electroplating liquid at a level of 2, and the electroplating operation was carried out at a temperature of about 50° C. at a current density of 40 A/dm$^2$ for about 22 seconds to provide base electroplating layers in a targeted weight of 22 g/m$^2$ formed on both surfaces of the steel strip.

In each of Examples 1 to 6 in which the resultant base electroplating layer was composed of a matrix consisting of a zinc (90%)—ion (10%) alloy and dispersoid particles consisting of 3% by weight of $SrCrO_4$ particles and 0.3% of weight of $Al_2O_3$ colloidal particles, the first electroplating liquid had the following composition.

| | |
|---|---|
| $ZnSO_4.7H_2O$ | 180 g/l |
| $FeSO_4.7H_2O$ | 10 to 450 g/l |
| $SrCrO_4$ | 5 to 60 g/l |

-continued

| | |
|---|---|
| $Al_2O_3$ | 0.5 to 60 g/l |

In each of Examples 2, 3, 5, 6, 8 to 12, 16 to 18 and 21 to 25, an additional electroplating layer in an amount of 1 to 5 g/m$^2$ and the composition shown in Table 1 was formed on the base electroplating layer surface by using a second electroplating liquid containing necessary metal ions, for example, Zn ions or a mixture of Zn ions with Fe, Co, Ni, Mn and/or Cr ions.

In each of Examples 3, 4, 6, 8, 10, 13 to 15, 19, 20, 24 and 25, a surface coating layer having the composition and the thickness as shown in Table 1 was formed on the base electroplating layer or the additional electroplating layer.

In the formation of the surface coating layer, the organic resinous material layer was formed by a roll-coating method and by using a water-soluble polyacrylic resin emulsion. Also, the chromate treatment was carried out in a coating manner, reaction manner or electrolytic manner.

The resultant plated composite steel strip was subjected to the following tests.

1. Cyclic corrosion resistance test

A painted specimen, which was prepared by a full-dip type chemical conversion treatment and a cationic paint-coating, and an unpainted specimen, were scratched and then subjected to a 50 cycle corrosion test. In each cycle of the corrosion test, the specimens were subjected to salt water-spraying at 35° C. for 6 hours, to drying at 70° C. at 60%RH for 4 hours, to wetting at 49° C., at a 95%RH or more for 4 hours, and then to freezing at −20° C. for 4 hours.

After the 50 cycle corrosion test, the formation of red rust and the depths of pits formed in the specimens were measured.

2. Paint adhesion property

A specimen was subjected to a full-dip type chemical conversion treatment, was coated three times with paint, and was then immersed in hot water at 40° C. for 10 days.

After the completion of the immersion step, the specimen was subjected to a cross-cut test in which the specimen surface was scratched in a chequered pattern at intervals of 2 mm to for 100 squares. Then an adhesive tape was adhered on the scratched surface of the specimen and was peeled from the specimen. The number of squares separated from the specimen was then counted.

The rust resistance was evaluated as follows.

| Class | Rust formation R (%) |
|---|---|
| 5 | $R = 0$ |
| 4 | $R \leqq 5$ |
| 3 | $5 < R \leqq 20$ |
| 2 | $20 < R \leqq 50$ |
| 1 | $50 < R$ |

The depth of corrosion was evaluated as follows.

| Class | Depth C (mm) of pits |
|---|---|
| 5 | $C = 0$ |
| 4 | $C \leqq 0.1$ |
| 3 | $0.1 < C \leqq 0.3$ |
| 2 | $0.3 < D \leqq 0.5$ |
| 1 | $0.5 < C$ |

The paint-adhesion property was evaluated as follows.

| Class | Peeled squares D (%) |
|---|---|
| 5 | $D = 0$ |
| 4 | $D \leqq 5$ |
| 3 | $5 < D \leqq 20$ |
| 2 | $20 < D \leqq 50$ |
| 1 | $50 < D$ |

The results of the tests are shown in Table 1.

TABLE 1

| Example No. | Coating: Base electroplating layer: Weight ($g/m^2$) | Matrix metal | Chromate particle | Additional particle | Additional electroplating layer | Surface coating layer | Corrosion Resistance: Unpainted: Red rust formation (%) | Corrosion depth | Painted: corrosion depth | Paint adhesion |
|---|---|---|---|---|---|---|---|---|---|---|
| Example | | | | | | | | | | |
| 1 | 21 | Zn—10% Fe | 3% $SrCrO_4$ | 0.3% $Al_2O_3$ | — | — | 4 | 3 | 3 | 2 |
| 2 | 21 | Zn—10% Fe | 3% $SrCrO_4$ | 0.3% $Al_2O_3$ | Zn—11% Ni (3 $g/m^2$) | — | 4 | 4 | 4 | 5 |
| 3 | 21 | Zn—10% Fe | 3% $SrCrO_4$ | 0.3% $Al_2O_3$ | Zn—11% Ni (3 $g/m^2$) | Resin (1 μm) | 4 | 4 | 4 | 5 |
| 4 | 21 | Zn—10% Fe | 3% $SrCrO_4$ | 0.3% $Al_2O_3$ | — | 20 $mg/m^2$ Cr-containing resin (1 μm) | 5 | 5 | 4 | 4 |
| 5 | 21 | Zn—10% Fe | 3% $SrCrO_4$ | 0.3% $Al_2O_3$ | Zn—11% Ni (3 $g/m^2$) + Co (0.5 $g/m^2$) | — | 4 | 3 | 4 | 5 |
| 6 | 21 | Zn—10% Fe | 3% $SrCrO_4$ | 0.3% $Al_2O_3$ | Zn—87% Fe (2 $g/m^2$) | Chromate (Cr: 60 $mg/m^2$) + resin (1.8 μm) | 5 | 5 | 4 | 4 |
| 7 | 20 | Zn—8% Sn—3% Cr | 10% $BaCrO_4$ | 0.5% $TiO_2$ + 1% $SnO_2$ | — | — | 4 | 3 | 4 | 1 |
| 8 | 20 | Zn—8% Sn—3% Cr | 10% $BaCrO_4$ | 0.5% $TiO_2$ + 1% $SnO_2$ | Zn—35% Mn—3% Cr (4 $g/m^2$) | 30 $mg/m^2$ Cr-containing resin (1.5 μm) | 5 | 5 | 5 | 4 |
| 9 | 22 | Zn—3% Co—1% Pb—0.3% Mo | 25% $PbCrO_4$ | 3% $ZrO_2$ | Zn—3% Cr (2 $g/m^2$) + Zn—10% Co (1 $g/m^2$) | — | 4 | 3 | 4 | 5 |
| 10 | 21 | Zn—10% Ni—3% Cr—2% Fe | 5% $ZnCrO_4$ | 1% $Cr_2O_3$ + 0.5% $Sb_2O_5$ | Fe—30% Ni (1 $g/m^2$) | 10 $mg/m^2$ Cr-containing resin (0.8 μm) | 5 | 5 | 4 | 5 |
| 11 | 21 | Zn—10% Ni—3% Cr—2% Fe | 5% $ZnCrO_4$ | 1% $Cr_2O_3$ + 0.5% $Sb_2O_5$ | Ni (1 $g/m^2$) + Fe (0.5 $g/m^2$) + Zn—10% Ni (1 $g/m^2$) | — | 4 | 4 | 4 | 4 |
| 12 | 19 | Zn—11% Ni | 3% $BaCrO_4$ | 1% $SiO_2$ | Zn—87% Fe (3.5 $g/m^2$) | — | 3 | 3 | 4 | 5 |
| 13 | 19 | Zn—11% Ni | 3% $BaCrO_4$ | 1% $SiO_2$ | — | 100 $mg/m^2$ Cr-containing resin (1 μm) | 5 | 5 | 5 | 4 |
| 14 | 21 | Zn—30% Fe | 6% $BaCrO_4$ | 1.5% $TiO_2$ | — | Resin (1 μm) | 4 | 4 | 4 | 5 |
| 15 | 21 | Zn—30% Fe | 6% $BaCrO_4$ | 1.5% $TiO_2$ | — | Chromate (Cr: 20 $mg/m^2$) + resin (1.5 μm) | 5 | 5 | 4 | 5 |
| 16 | 21 | Zn—0.9% Co | 10.9% $SrCrO_4$ | 11.0% $Al_2O_3$ | Zn (3 $g/m^2$) | — | 4 | 4 | 4 | 3 |
| 17 | 21 | Zn—7% Sn—10.4% Ni | 12% $BaCrO_4$ | 2.0% $ZrO_2$ + 1.3% $TiO_2$ | Zn—10% Co (4 $g/m^2$) | — | 4 | 4 | 4 | 5 |
| 18 | 20 | Zn—1.5% Sb | 1.6% $SrCrO_4$ | 0.9% $ZrO_2$ + 1.4% $Cr_2O_3$ + 1.4% $TiO_2$ | Zn—30% Mn (2 $g/m^2$) | — | 4 | 4 | 4 | 5 |
| 19 | 20 | Zn—2.6% Pb—1.5% Co—1.5% Sn | 0.9% $BaCrO_4$ | 1.3% $Cr_2O_3$ + 3.6% $TiO_2$ | — | Resin (1.5 μm) | 4 | 4 | 4 | 4 |
| 20 | 20 | Zn—2.6% Pb—1.5% Co—1.5% Sn | 0.9% $BaCrO_4$ | 1.3% $Cr_2O_3$ + 3.6% $TiO_2$ | — | 60 $mg/m^2$ Cr-containing resin (1.5 μm) | 5 | 5 | 5 | 4 |
| 21 | 20 | Zn—2.6% Pb—1.5% Co—1.5% Sn | 0.9% $BaCrO_4$ | 1.3% $Cr_2O_3$ + 3.6% $TiO_2$ | Zn—85% Fe (3 $g/m^2$) | — | 3 | 3 | 4 | 5 |
| 22 | 20 | Zn—2.6% Pb—1.5% Co—1.5% Sn | 0.9% $BaCrO_4$ | 1.3% $Cr_2O_3$ + 3.6% $TiO_2$ | Zn—11% Ni (3.5 $g/m^2$) | — | 4 | 3 | 4 | 5 |

TABLE 1-continued

| Example No. | Coating: Base electroplating layer: Weight ($g/m^2$) | Matrix metal | Chromate particle | Additional particle | Additional electroplating layer | Surface coating layer | Corrosion Resistance: Unpainted: Red rust formation (%) | Corrosion depth | Painted: corrosion depth | Paint adhesion |
|---|---|---|---|---|---|---|---|---|---|---|
| 23 | 18 | Zn—30% Mn | 1% $PbCrO_4$ | 3% $SiO_2$ | Zn—11% Ni (3.5 $g/m^2$) | — | 4 | 3 | 4 | 5 |
| 24 | 18 | Zn—30% Mn | 1% $PbCrO_4$ | 3% $SiO_2$ | Zn—11% Ni (3.5 $g/m^2$) | 60 $mg/m^2$ Cr-containing resin (1.5 μm) | 5 | 5 | 5 | 4 |
| 25 | 18 | Zn—30% Mn | 1% $PbCrO_4$ | 3% $SiO_2$ | Zn—11% Ni (3.5 $g/m^2$) | Resin (1 μm) | 4 | 4 | 4 | 5 |
| Comparative Example | | | | | | | | | | |
| 1 | 23 | Zn—12% Ni | — | — | — | — | 1 | 1 | 3 | 5 |
| 2 | 23 | Zn | 0.05% $BaCrO_4$ | — | — | — | 1 | 1 | 2 | 3 |
| 3 | 23 | Zn | 0.3% $BaCrO_4$ | — | — | — | 2 | 1 | 2 | 2 |
| 4 | 20 | Zn—1% Ni—1% Cr | — | 1% $Al_2O_3$ | — | — | 2 | 2 | 3 | 3 |
| 5 | 20 | Zn—10% Ni—0.5% Cr | — | 3% $SiO_2$ | — | — | 3 | 2 | 3 | 3 |
| 6 | 22 | Zn—9% Ni | 1% $BaCrO_4$ | — | — | — | 2 | 2 | 2 | 2 |
| 7 | 22 | Zn—13% Ni | 2.5% $BaCrO_4$ | — | — | — | 3 | 2 | 3 | 1 |

We claim:

1. A high corrosion resistant plated composite steel strip comprising:

(A) a substrate consisting of a steel strip; and (B) a corrosion resistant coating layer formed on a least one surface of the steel strip substrate and comprising a base electroplating layer which comprises (a) a matrix consisting of a member selected from the group consisting of zinc and zinc alloys; and (b) a number of dispersoid particles evenly distributed in the matrix and consisting of a mixture of (i) at least one type of substantially water-insoluble chromate fine particles, and (ii) at least one type of additional fine or colloidal particles consisting of a member selected from the group consisting of $SiO_2$, $TiO_2$, $Cr_2O_3$, $Al_2O_3$, $ZrO_2$, $SnO_2$ and $Sb_2O_5$.

2. The corrosion resistant plated composite steel strip as claimed in claim 1, wherein said corrosion resistant coating layer has an additional electroplating layer formed thereon and comprising at least one type of metal selected from the group consisting of Zn, Fe, Co, Ni, Mn and Cr.

3. The corrosion resistant plated composite steel strip as claimed in claim 1, wherein the corrosion resistant coating layer has a surface coating layer formed on the base electroplating layer and having a single coating layer structure comprising an organic resinous material or a double coating layer structure consisting of an under layer formed by applying a chromate treatment to the base electroplating layer surface and an upper layer formed on the under layer and comprising an organic resinous material.

4. The corrosion resistant plated composite steel strip as claimed in claim 3 wherein chromium ions are evenly mixed in said resinous material.

5. The corrosion resistant plated composite steel strip as claimed in claim 2, wherein the corrosion resistant coating layer has a surface coating layer formed on the additional electroplating layer and having a single coating layer structure comprising an organic resinous material or a double coating layer structure consisting of an under layer formed by applying a chromate treatment to the additional electroplating layer surface and an upper layer formed on the under layer and comprising an organic resinous material.

6. The corrosion resistant plated composite steel strip as claimed in claim 5 wherein chromium ions are evenly mixed in said resinous material.

7. The corrosion resistant plated composite steel strip as claimed in claim 1, wherein the zinc alloy consists of Zn and at least one additional metal member selected from the group consisting of Fe, Co, Mn, Cr, Sn, Sb, Pb, Ni and Mo.

8. The corrosion resistant plated composite steel strip as claimed in claim 1, wherein the dispersoid particles are is a total content of 30% or less based on the weight of the base electroplating layer.

9. The corrosion resistant plated composite steel strip as claimed in claim 1, wherein the base electroplating layer is in a total amount of from 5 to 50 $g/m^2$.

10. The corrosion resistant plated composite steel strip as claimed in claim 1, wherein the substantially water-insoluble chromate fine particles are in a content of from 0.1% to 30% based on the total weight of the base electroplating layer.

11. The corrosion resistant plated composite steel strip as claimed in claim 1, wherein the substantially water-insoluble chromate fine particles consist of at least one member selected from the group consisting of $PbCrO_4$, $BaCrO_4$, $SrCrO_4$, $ZnCrO_4$, and $CaCrO_4$.

12. The corrosion resistant plated composite steel strip as claimed in claim 1, wherein the additional fine or colloidal particles are in content of from 0.1% to 30% based on the total weight of the base electroplating layer.

* * * * *